US010036173B2

(12) United States Patent
Liu

(10) Patent No.: US 10,036,173 B2
(45) Date of Patent: Jul. 31, 2018

(54) POOL APPARATUS

(71) Applicant: Bestway Inflatables & Material Corp., Shanghai (CN)

(72) Inventor: Feng Liu, Shanghai (CN)

(73) Assignee: Bestway Inflatables & Material Corp., Shanghai (CN)

( * ) Notice: Subject to any disclaimer, the term of this patent is extended or adjusted under 35 U.S.C. 154(b) by 25 days.

(21) Appl. No.: 15/153,256

(22) Filed: May 12, 2016

(65) Prior Publication Data

US 2017/0138075 A1 May 18, 2017

(30) Foreign Application Priority Data

Nov. 12, 2015 (CN) ..... 2015 2 0898685 U

(51) Int. Cl.
*E04H 4/00* (2006.01)
*E04H 4/14* (2006.01)

(52) U.S. Cl.
CPC ... *E04H 4/0056* (2013.01); *E04H 2004/0068* (2013.01); *E04H 2004/146* (2013.01)

(58) Field of Classification Search
CPC ..... E04H 4/0056; E04H 2004/0068; E04H 2004/146; E04H 2004/147
USPC ..... 4/506, 507, 513
See application file for complete search history.

(56) References Cited

U.S. PATENT DOCUMENTS 2,580,942 A * 1/1952 Murad ..... A47K 3/064 4/506
3,225,362 A * 12/1965 Barrera ..... E04H 4/0018 220/4.16
3,486,289 A * 12/1969 Lavack ..... E04H 4/0018 29/429
3,522,614 A * 8/1970 Gould ..... E04H 4/0043 52/169.7
3,562,822 A * 2/1971 Wall ..... E04H 4/0018 4/506
3,749,244 A * 7/1973 Jannuzzi, Jr. ..... E04H 4/0043 210/167.11

(Continued)

FOREIGN PATENT DOCUMENTS

CN 203879057 U * 10/2014 ..... E04H 4/14

OTHER PUBLICATIONS

CN203879057U—English Translation; machine generated, Sep. 2017.*

*Primary Examiner* — Benjamin R Shaw
(74) *Attorney, Agent, or Firm* — McDermott Will & Emery LLP

(57) ABSTRACT

A pool apparatus has a surrounding side frame, a tarpaulin and a top portion frame. The surrounding side frame provides a closed geometrical shape defined on the ground after the tarpaulin is surrounded with respect to the ground. The tarpaulin may be constituted by various kinds of waterproof materials. The tarpaulin has a bottom portion, a side portion and a top portion. The shape of the bottom of the tarpaulin corresponds to the closed geometrical shape. The side portion of the tarpaulin connects to the bottom portion and surrounding the surrounding side frame. The top portion of the tarpaulin connects to the side portion of the tarpaulin. The thickness of top portion of the tarpaulin is thicker than the thickness of the other portion s of the tarpaulin. The top portion frame clips the top portion to fix the tarpaulin.

18 Claims, 18 Drawing Sheets

(56) References Cited

U.S. PATENT DOCUMENTS

| | | | | | |
|---|---|---|---|---|---|
| 4,062,158 | A * | 12/1977 | Kaufmann | E04H 4/0018 | 4/506 |
| 4,158,244 | A * | 6/1979 | Stefan | E04H 4/142 | 160/391 |
| 4,223,498 | A * | 9/1980 | Ventrice | E04H 4/005 | 220/4.16 |
| 5,416,932 | A * | 5/1995 | Ventrice | E04H 4/14 | 4/496 |
| 6,209,151 | B1 * | 4/2001 | Schwimmer | E04H 4/0018 | 4/506 |
| 6,393,632 | B1 * | 5/2002 | Epple | E04H 4/101 | 4/502 |
| 2008/0005832 | A1 * | 1/2008 | Aguilar De Kegel | E04H 4/0018 | 4/506 |
| 2008/0235862 | A1 * | 10/2008 | Lewis | E04H 4/142 | 4/506 |

* cited by examiner

POOL APPARATUS

FIELD OF INVENTION

The present invention is related to a pool apparatus, and more particularly related to a pool apparatus that may be installed easily.

BACKGROUND

Pools have very long history for providing various functions, such as being a swimming pool or a massage device. Some pools are manufactured by fixed structures, such as digging a hole in the ground and strengthening waterproof pool surface at their surroundings. Some pools may be installed for temporary use, such as using a large plastic tarp with a supporting structure to construct a water accommodating structure.

In the past, such pools are usually more expensive and complicated for assembling. If the manufacture cost for a pool can be further lowered down, and/or the pool assembling procedure can be more convenient, there will be more people choosing such products to enjoy the varieties of benefits of pools.

SUMMARY OF INVENTION

A pool apparatus is designed for providing people to use with safety. An embodiment of such pool apparatus has a surrounding side frame, a tarpaulin and a top portion frame. The surrounding side frame provides a closed geometrical shape defined above the ground after the tarpaulin is surrounded with respect to the ground. The geometrical shape may be a circle, an ellipse, a polygon, and/or other shapes set for aesthetic or for matching the terrain. The tarpaulin can be constituted by variety of waterproof materials. The tarpaulin has a bottom portion, a side portion, and a top portion. The shape of the bottom portion of the tarpaulin corresponds to the closed geometrical shape. The side portion of the tarpaulin connects to the bottom portion and surrounds the surrounding side frame. The top portion of the tarpaulin connects to the side portion of the tarpaulin. In the embodiment, the thickness of the top portion of the tarpaulin is thicker than the thickness of the other portions of the tarpaulin. The top portion frame clips the top portion to fix the tarpaulin. For example, the top portion frame comprises a plurality of clip strips. The clip strips have an elastic trench, configured to clip the top portion of the tarpaulin.

In addition, in one approach, the top portion has a folded portion, and the folded portion is constituted by folding the tarpaulin with a predetermined folding number on the top portion. For example, the predetermined folding number may be two fold, three fold, or other higher folding number.

In one approach, the top portion frame has a plurality of clip strips. The clip strips have an elastic trench, configured to clip the top portion of the tarpaulin. The mentioned folding number may be determined according to the thickness of the tarpaulin and the width of the entrance of the elastic trench. In other words, for tarpaulins with different thickness, as long as by changing the folding number on the top portion of the bottom top, the thickness of the top portion of the tarpaulin may be adjusted. By this design, even changing the tarpaulin to different ones, the same clip strip and the corresponding surrounding side frame may still be used. For example, for thinner tarpaulins, a designer may set a larger folding number on the top portion of the tarpaulin so as to match the entrance width of the elastic trench.

In another approach, a designer may increase the thickness of the tarpaulin on the top portion by adding an attached object on the tarpaulin. As long as capable of increasing the thickness of the top portion of the tarpaulin, the attached object is not limited by shapes or materials. Furthermore, it would be better for increasing certain elasticity or frictional force for further stabilizing the fixing. For example, elasticity sponges, foams, metal sheets, plastic strips, plastic blocks, etc. may be applied with pasting, suturing, covering. Another approach may also include direct processing of thickening as an attached object on the top portion of the tarpaulin.

In one approach, a surrounding side frame may be constituted by metals or other rectangular thin sheet capable of providing a fixed rigid support force. For users to conveniently curing the rectangular thin sheet, the rectangular thin sheet may be set a plurality of lines for folding in the direction perpendicular to the ground.

In another approach, the surrounding side frame may include a plurality of side pillars and a plurality of frame surface structures. Two sides of the frame surface structures are supported by corresponding two side support pillars.

In addition, in another approach, the clip strips on the top portion frame may be constructed with two long tubes and a long tube connection port. The long tube connection port connects the two long tubes, providing a fixed elasticity and forming an elastic trench between the two long tubes, and providing an entrance configured to clip the top portion of the tarpaulin.

In addition, the clip strips may further include a plurality of connection bolts for inserting these long tubes to connect different long tubes in series and thus construct the top portion frame. A blocking part may be set in the middle of these kind of connection bolts, configured to control the connection bolts and the relative positions between the two long tubes.

In one of the approaches, there may be an isolation bar inside the long tube, dividing the interior of the long tube into two channels. The connection bolts may be inserted into one of the channels, and strengthen the fixity between the connection bolts and the long tubes by an elastic force generated by the deformation of the isolation bar caused by the insertion of connection bolts into the long tubes.

In another approach, the top portion frame may include a corner buckle structure, configured to provide a plurality of clip strips to form the top surface frame, and the clip strips have a flat surface larger than three square centimeters on the top portion. On one hand it can be more artistic. On the other hand, it may allow users to put on small things on the flat surface.

In addition to the design of the strip shape or the tube shape, the clip strips may also be designed as inverse U shape clips, so as to constitute the elastic trench, or being designed to other corresponding structures, as long as the clip strips can stick the top portion of the tarpaulin.

In addition, for some waterproof tarpaulin with plastic materials, after the folding of the top portion, the fold portion may be fixed by heating welding, sewing, pressurizing or other ways.

In some embodiments, the maximum width of the closed geometrical shape of the above mentioned bottom portion of the water pool may be larger than two meters, and the height of the surrounding side frame may be larger than sixty centimeters. For example, the pool apparatus may be made with the diameter over than three meters, height over than ninety centimeters, and the water carrying amount over than eight thousand liters.

In addition, in some approaches, the pool apparatus may further have a bottom portion frame, configured to carry the surrounding side frame on the top of the bottom portion frame. For the convenience and the costs for manufacturing, the bottom portion frame may use the same structure as that of the top portion frame, such as the above mentioned plurality of tube structures of clip strips, also setting elastic trenches facing up and settling the surrounding side frame to stick inside.

In some approaches, the side portion of the tarpaulin and the surrounding side frame may have two corresponding holes configured to form a water outlet and a water inlet, or have more water outlets or water inlets so as to connect a filtering pump.

Different ways of permutations and applications may be used in each of the technical method in embodiments. They may lower down the whole costs of manufacturing pools, and may generate certain contribution and improvement to the convenience of installation.

DETAILED DESCRIPTION

Figure 1:
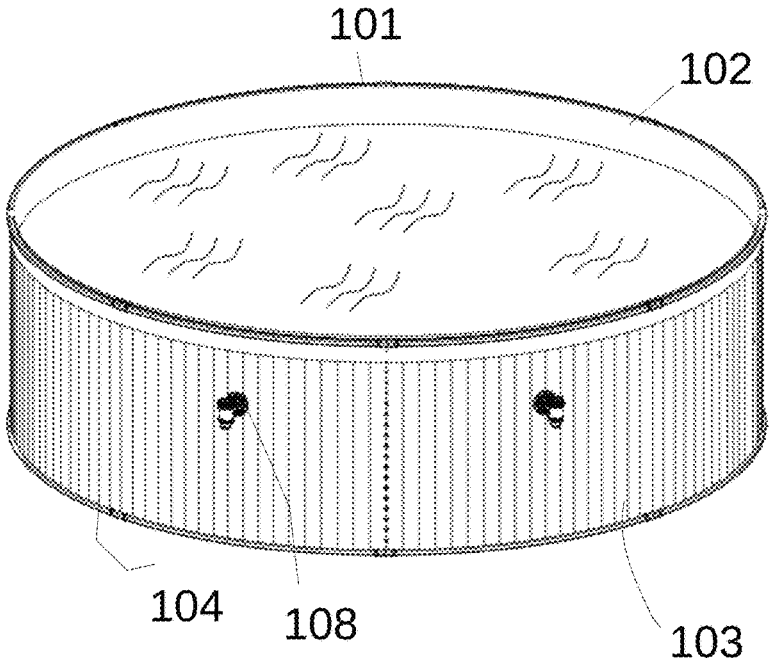
FIG. 1 exemplifies an embodiment of a stereogram and a schematic drawing of side view of a pool apparatus.

Please Refer to FIG. 1. FIG. 1 exemplifies an embodiment of a stereogram and a schematic drawing of side view of a pool apparatus. The pool apparatus can provide a place for people to do activities therein such as being a swimming pool or for a massage bath. The pool apparatus has a top portion frame 101, a tarpaulin 102, a surrounding side frame 103, a bottom portion frame 104, and one or more then one water inlets and/or water outlet 108 set on the surrounding side frame 103.

Figure 2:
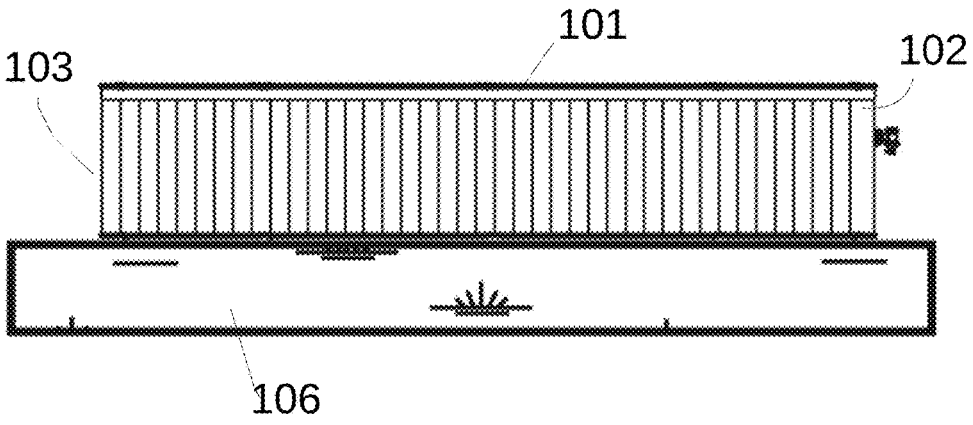
FIG. 2 exemplifies an embodiment of a pool apparatus settled on a ground.

Please also refer to FIG. 2. FIG. 2 exemplifies an embodiment of a pool apparatus settled on a ground 106. The surrounding side frame 103 is perpendicular to the ground 106 and forms a circular closed shape by surrounding the ground 106. The top portion frame 101 fixes and clips the tarpaulin 102. Please be noted that, in the examples shown in FIG. 1 and FIG. 2, the geometrical shape of the bottom surface of the pool apparatus is circle. However, in other embodiments, it may be surrounded to be form a circle, an ellipse, a polygon, or various kinds of other shapes.

The tarpaulin 102 may be constituted by various waterproof materials, such as a fabric coated with waterproof coating, a plastic coating, an elastic coating, other braids or other materials. The tarpaulin 102 has a bottom portion 12, a side portion 10 and a top portion. The shape of the bottom portion 12 of the tarpaulin 102 corresponds to the mentioned closed geometrical shape. The side portion 10 of the tarpaulin 102 connects to the bottom portion 12 and surrounds the surrounding side frame 103. The top portion of the tarpaulin 102 connects to the side portion 10 of the tarpaulin 102. In the embodiment, the thickness of the top portion of the tarpaulin 102 is thicker than the thickness of other portions of the tarpaulin 102. The top portion frame 101 clips the top portion to fix the tarpaulin 102.

Figure 3:
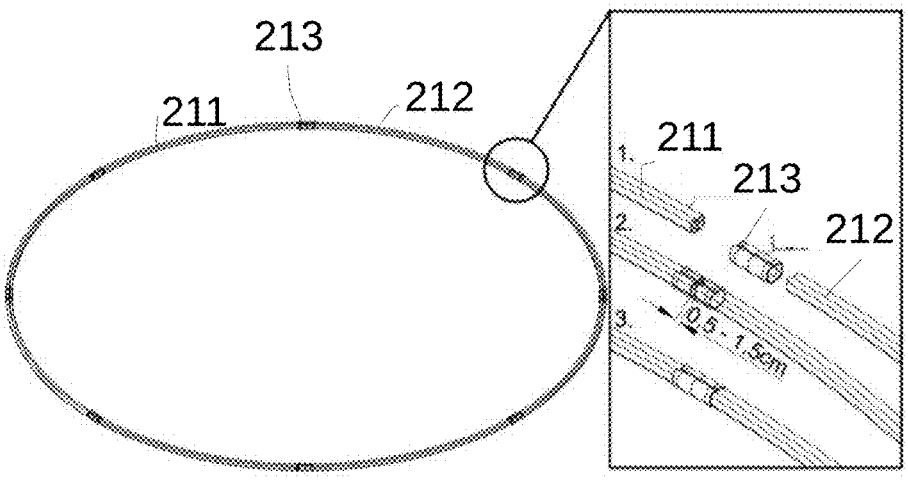
FIG. 3 exemplifies a bottom portion frame configured to settle a surrounding side frame.

Next, please refer to FIG. 3. FIG. 3 exemplifies a bottom portion frame, configured to settle a surrounding side frame. The bottom portion frame consists of a plurality of clip strips, such as clip strips 211, 212. The clip strips 211, 212 are fixed via a sleeve bolt via socketing. In the example, each clip strip has two long tubes, and the two long tubes are connected by a long tube connection port forming an elastic trench between long tubes. The elastic trench may be used to put in the surrounding side frame. Detailed configurations about the clip strip and its elastic trench will be illustrated in details later.

Figure 4:
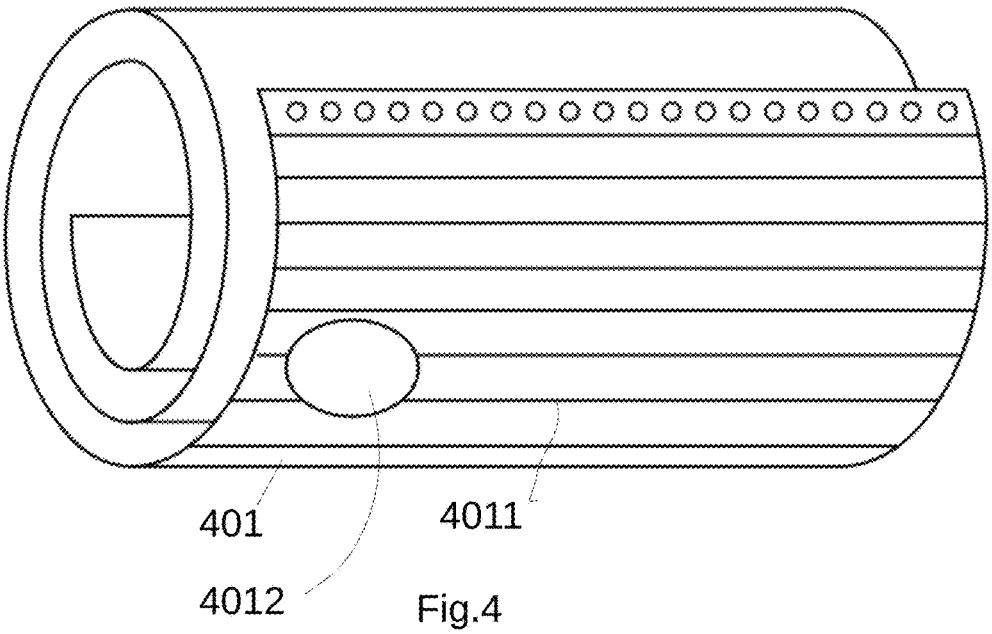
FIG. 4 exemplifies a surrounding side frame constituted by a rectangular thin sheet.

Please refer to FIG. 4. FIG. 4 exemplifies a surrounding side frame 401 constituted by a rectangular thin sheet. For example, the surrounding side frame 401 may be constituted by a metal material or other materials having a fixed rigid support force.

For the convenience of curing and for strengthening the rigidity, the surrounding side frame 401 further has lines for folding 4011. These lines are parallel to each other, and perpendicular to the bottom surface after installation, in order to provide better rigidity. In addition, the surrounding side frame 401 may also set a hole 4012, configured to be a water outlet or a water inlet.

Figure 5:
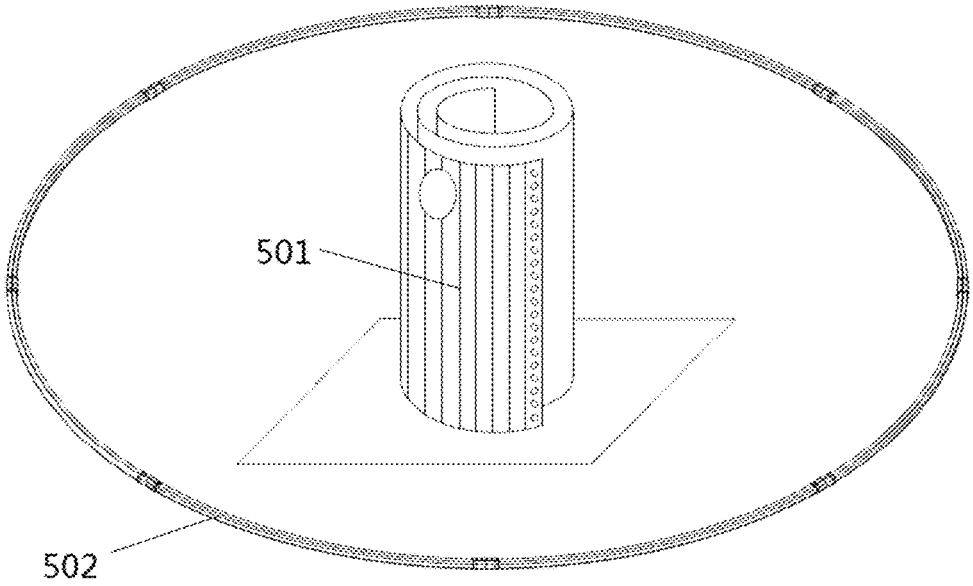
FIG. 5 exemplifies assembling of the surrounding side frame and the bottom portion frame.

Next, please refer to FIG. 5. FIG. 5 exemplifies a first schematic drawing of processing assemblies of the surrounding side frame 501 and the bottom portion frame 502. First, lay the bottom portion frame 502 on the ground. For the convenience of laying, the surrounding side frame 501 may be put on the middle of the bottom portion frame 502.

Figure 6:
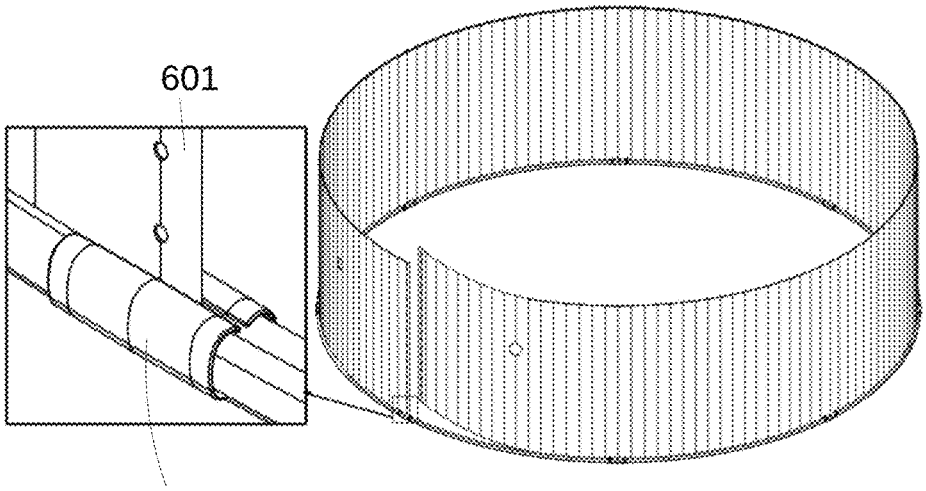
FIG. 6 exemplifies expanding the surrounding side frame with the bottom portion frame, surrounding the ground and constituting the mentioned closed geometrical shape.

Please refer to FIG. 6. FIG. 6 exemplifies expanding the surrounding side frame with the bottom portion frame, surrounding the ground and constituting the mentioned closed geometrical shape. In FIG. 6, a bottom portion frame 602 may provide an elastic trench, configured to provide a thin sheet put into the surrounding side frame 601.

Please refer to FIG. 5 and FIG. 6. In the example of FIG. 5, since the surrounding side frame 601 is a curable rectangular thin sheet in origin, it may constitute the surrounding side frame 601 as shown in FIG. 6 after the expansion. In FIG. 6, the thin sheet of the surrounding side frame 601 is inserted into the elastic trench of the bottom portion frame 602, generating a fixed clip force, and being convenient to fix the shape.

Another approach is to attach the bottom portion frame 602 directly to the bottom portion of the surrounding side frame 601, or without setting the bottom portion frame 602. These different assembling ways all belongs to the scope of the invention.

Figure 7:
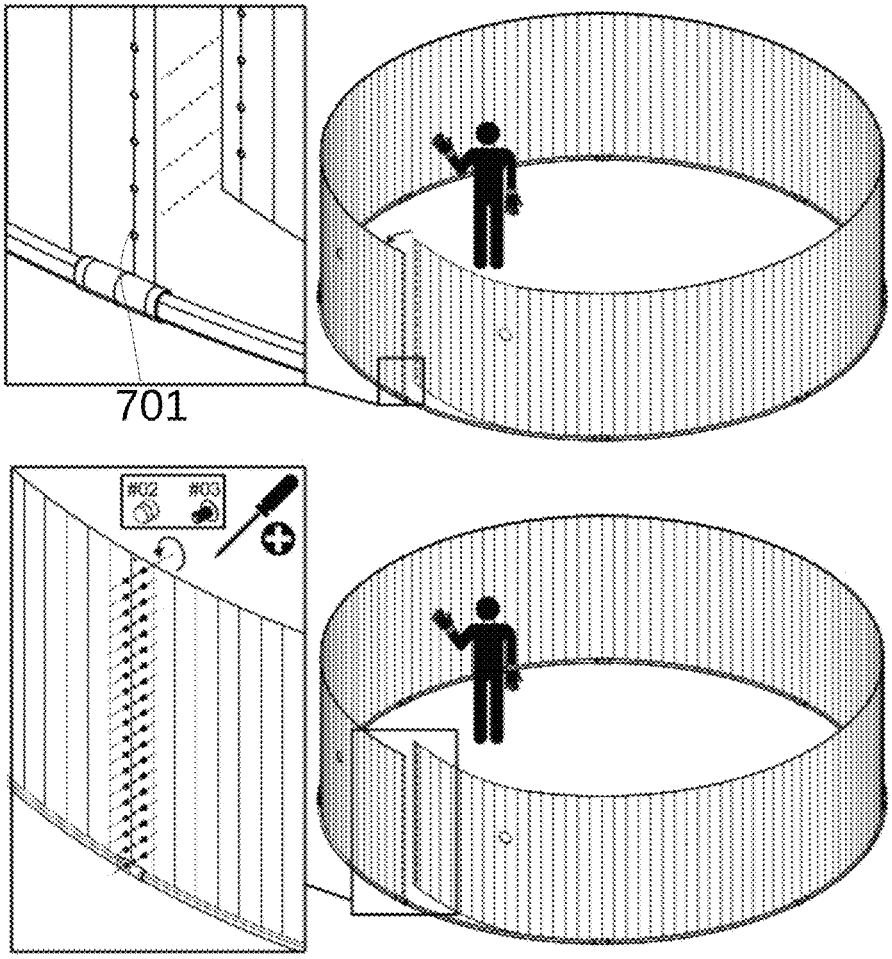
FIG. 7 exemplifies sealing operation to the surrounding side frame.

FIG. 7 exemplifies how to process a sealing operation to the surrounding side frame. In FIG. 7, a plurality of holes 701, which can be fixed by screw bolts are set on the edge of the surrounding side frame. Users can put screw bolts in these holes, so as to process the closed fixing on the surrounding side frame.

If necessary, attached objects such as tapes may be further added to the place where the surrounding side frame being closed, so as to avoid rough surfaces or to provide further waterproof protection function.

Figure 8:
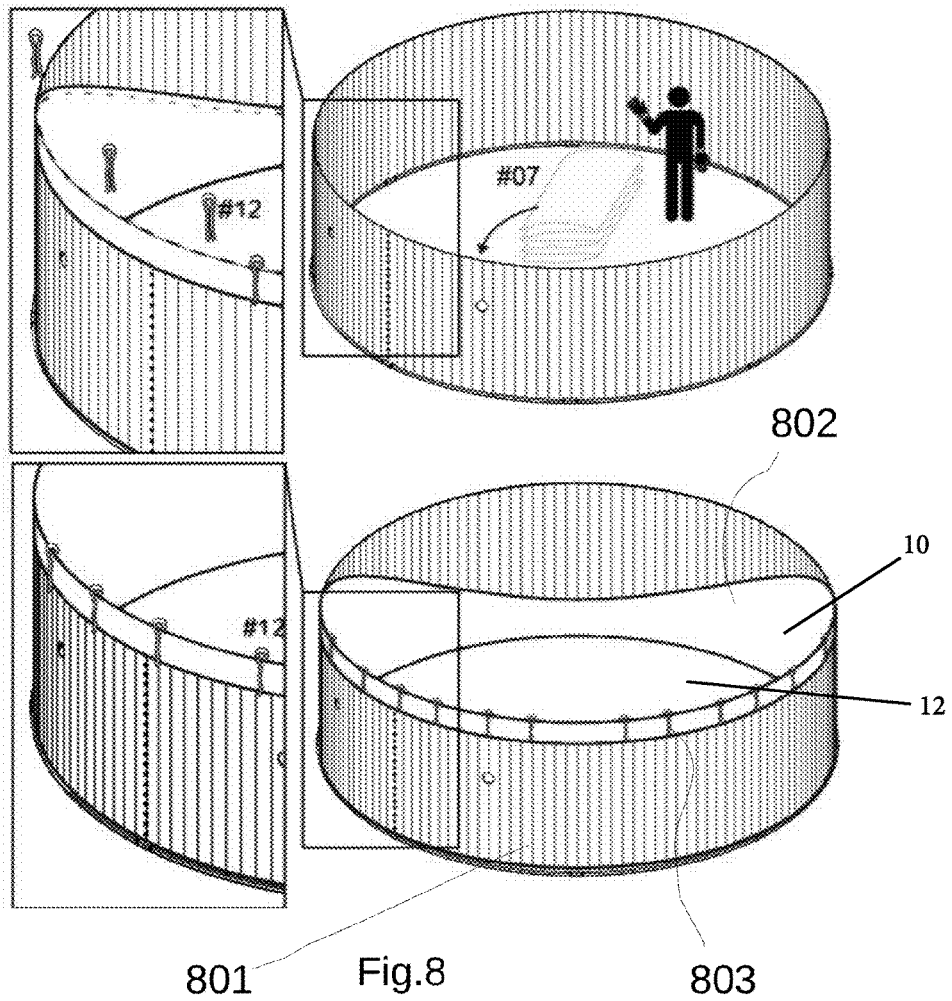
FIG. 8 exemplifies an operation of further settling a tarpaulin to the surrounding side frame.

Please refer to FIG. 8. FIG. 8 exemplifies an operation of further settling a tarpaulin 802 to the surrounding side frame 801. In FIG. 8, users expand the tarpaulin 802, so that the bottom portion 12 of the tarpaulin 802 is put on the ground, and the side portion 10 of the tarpaulin 802 connects to the surrounding side frame. After that, clip the top portion of the tarpaulin 802 on the surrounding side frame 801 by an elastic clip 803.

Figure 9:
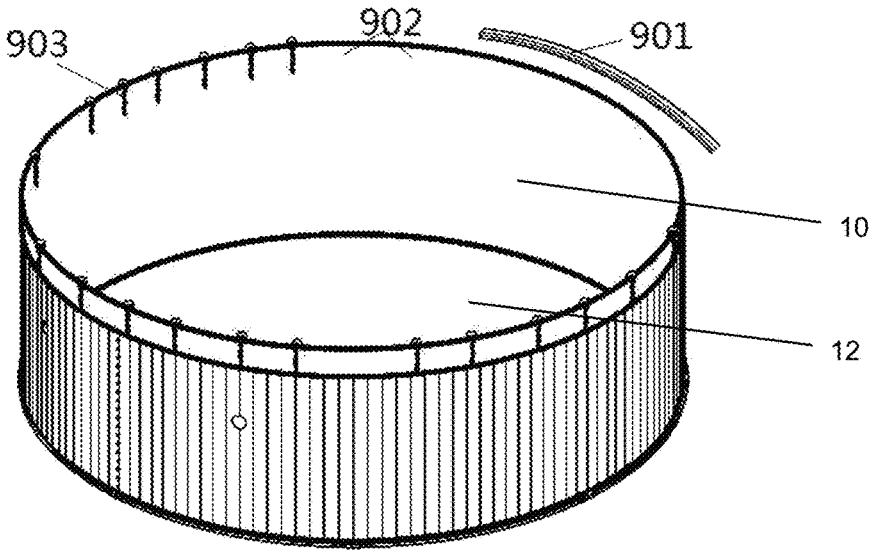
FIG. 9 exemplifies installing the top portion frame to the pool apparatus.

Please refer to FIG. 9. FIG. 9 exemplifies the steps of how to install the top portion frame to the pool apparatus after the mentioned operations. In FIG. 9, a top frame is constituted by a plurality of clip strips 901. The clip strips 901 has an elastic trench. Before settling the clip strips 901, the settled clip strips 903 in the previous step may be progressively removed. After removing the clip strips 903, the elastic trench of the clip strips 901 are inserted into the top portion of the tarpaulin 902, and the top portion of the tarpaulin 902 is clipped between the surrounding side frame and the clip strips 901.

Figure 10:
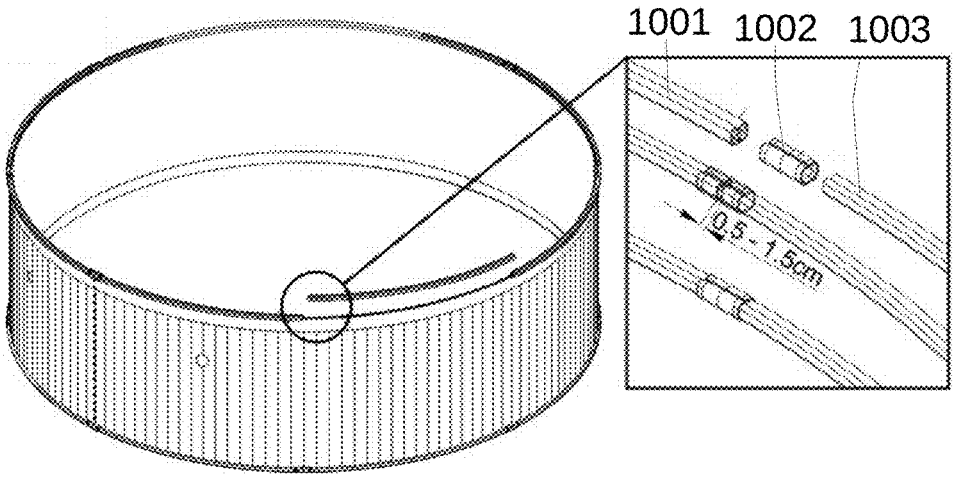
FIG. 10 exemplifies connections between clip strips by a sleeve bolt.

Please refer to FIG. 10. FIG. 10 exemplifies connections between clip strips 1001, 1003 by sleeve bolts 1002. The holes of the sleeve bolts 1002 correspond to the appearances of the clip strips 1001, 1003, so as to let the clip strips 1001, 1003 inserting smoothly into corresponding holes of the sleeve bolts 1002, thus achieving better fixing effect.

Figure 11:
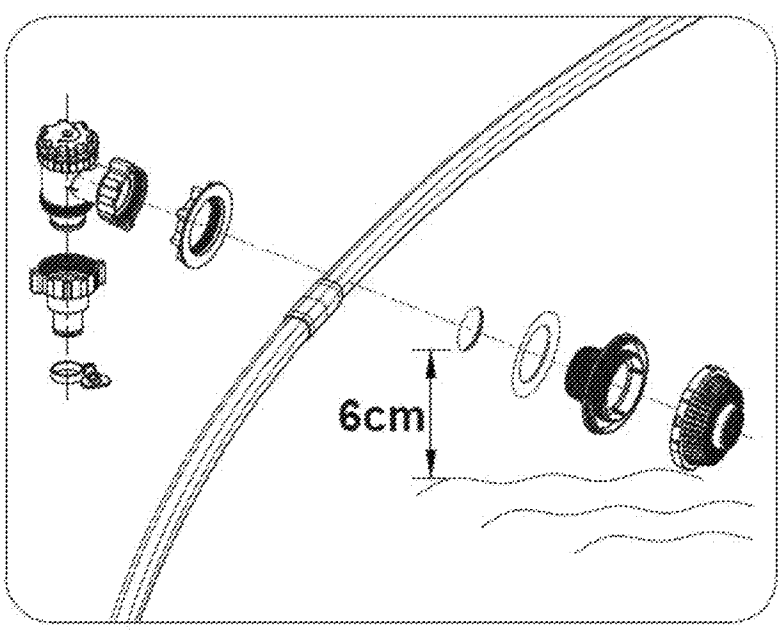
FIG. 11 exemplifies settling a water outlet and a water inlet on the side of the pool apparatus.
Figure 11:
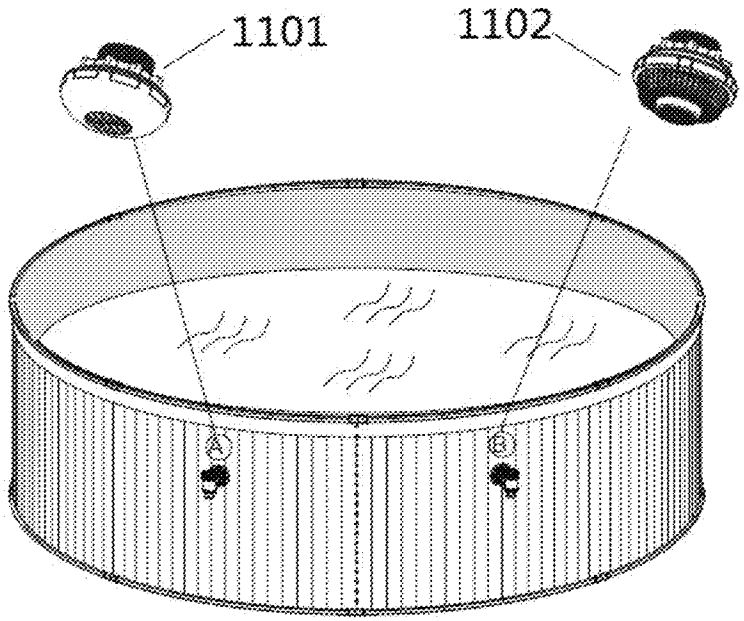

Please refer to FIG. 11. FIG. 11 exemplifies settling a water inlet 1101 and a water outlet 1102 on the side of the pool apparatus. The two valve structures may be set on the surrounding side frame and the corresponding holes set on the tarpaulin, and to further connect to a water filtering pump to ensure the quality of water of the pool apparatus maintained in good condition. Or, one can process the heating/cooling procedure, etc. to water.

Figure 12A:
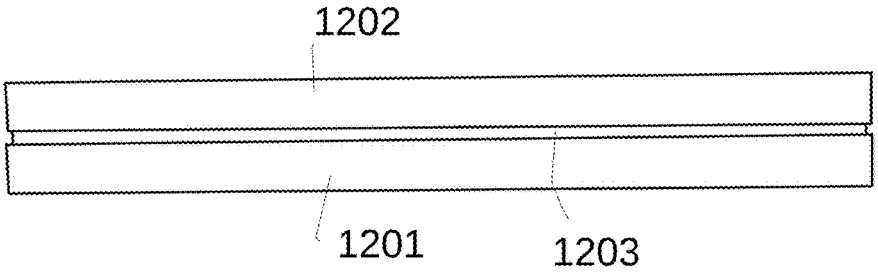
FIGS. 12A, 12B and 12C exemplify a top view, side view, and a stereogram of a structure of a clip strip used on the top portion frame.
Figure 12B:
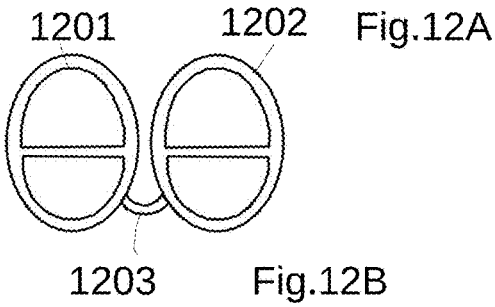
Figure 12C:
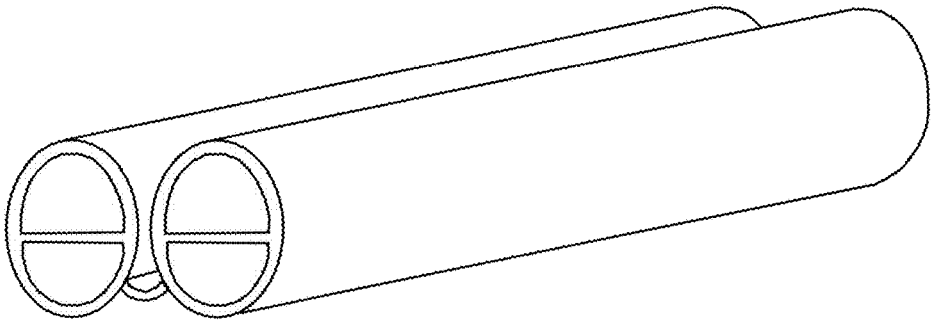

Please refer to FIGS. 12A, 12B, and 12C. FIGS. 12A, 12B and 12C exemplify a top view, side view, and a stereogram of a structure of a clip strip used on the top portion frame.

The clip strip has two long tubes 1201, 1202 and a long tube connection port 1203 configured to connect the two long tubes 1201, 1202.

Figure 13A:
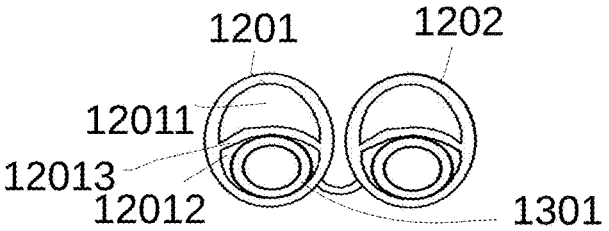
FIG. 13A and FIG. 13B exemplify a schematic drawing of connecting two adjacent clip strips together by a connecting bolt.
Figure 13B:
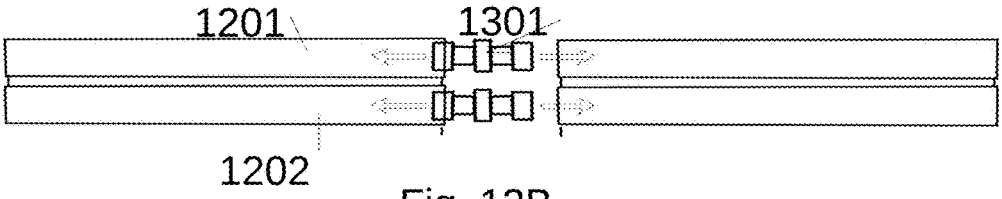

Please refer to FIGS. 13A and 13B. FIG. 13A and FIG. 13B exemplify a schematic drawing of connecting two adjacent clip strips 1201, 1202 together by a connecting bolt 1301. In the example, the connection bolt 1301 has a blocking part in the middle of the connection bolt 1301, configured to control a relative position between the connection bolt 1301 and the two clip strips 1201, 1202. In the example, the clip strip 1201 has an isolation bar (inside the clip strip 1201), dividing the interior of the clip strip 1201 into two channels 12011, 12012, wherein as the connection bolt sticks into one of the channel 12012, a certain change of shapes of the long tube of the clip strips and (a certain change of shapes of) the isolation bar 12013 are caused and generated. The change of the shapes generates an additional elastic force to fix more stable the connection bolt 1301 and the clip strips 1201, 1202.

The aforementioned sleeve bolts may further socket to the outer side of the clip strips, providing more stable fixing effect mutually. However, in some embodiments, the sleeve bolts and the connection bolt can make different assemblies according to the needs. The two sides of the connection bolt may be roughened, bulged out, or lined, in order to strengthen the frictional force.

Figures 14A, 14B:
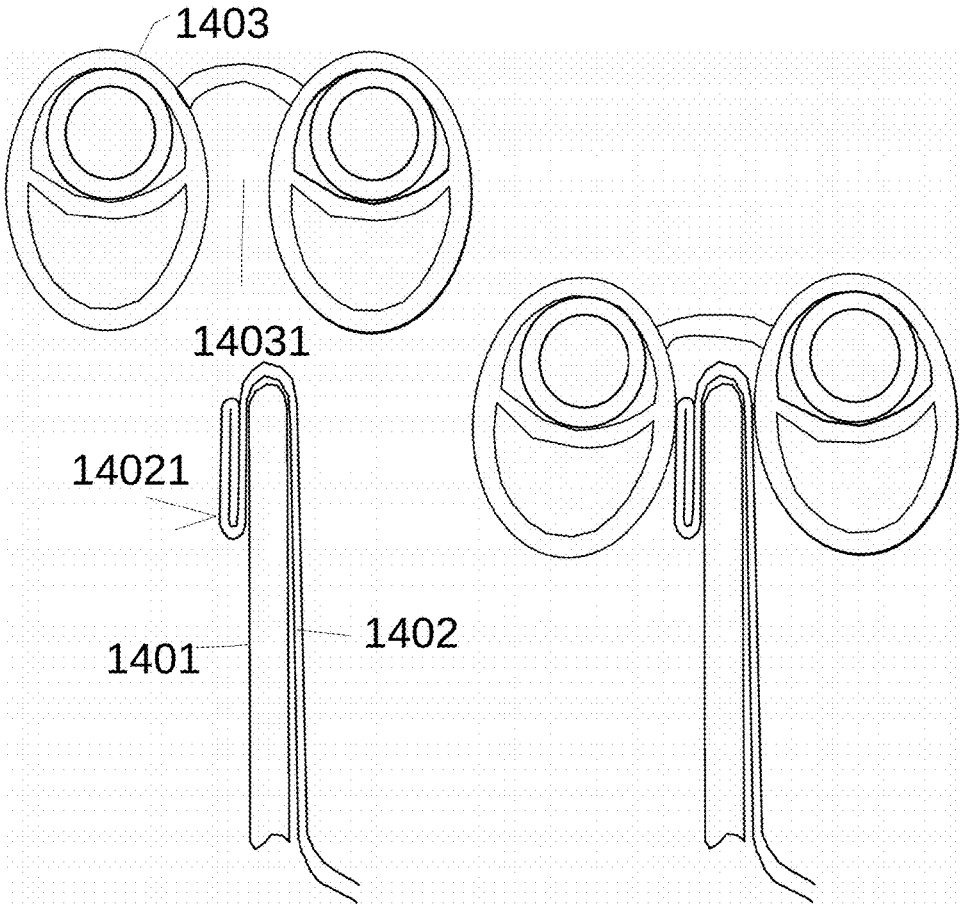
FIG. 14A and FIG. 14B exemplify the operation of socketing the clip strip to the tarpaulin of FIG. 13.

Please refer to FIG. 14A and FIG. 14B. FIG. 14A and FIG. 14B exemplify the operation of socketing the clip strip 1403 to the tarpaulin 1402 of FIG. 13. A practical operations include first leaning the top portion 14021 of the tarpaulin 1402 against the surrounding side frame 1401. Next, align the entrance of the elastic trench 14031 between the two long tubes of the clip strip 1403 towards the top portion 14021 of the tarpaulin 1402. There are certain deformations when the two long tubes of the clip strip 1403 and the long tube connection port abutting the tarpaulin 1402. A fixed elastic force generated by this kind of deformations can clip the top portion 14021 of the tarpaulin 1402 better.

Figure 15:
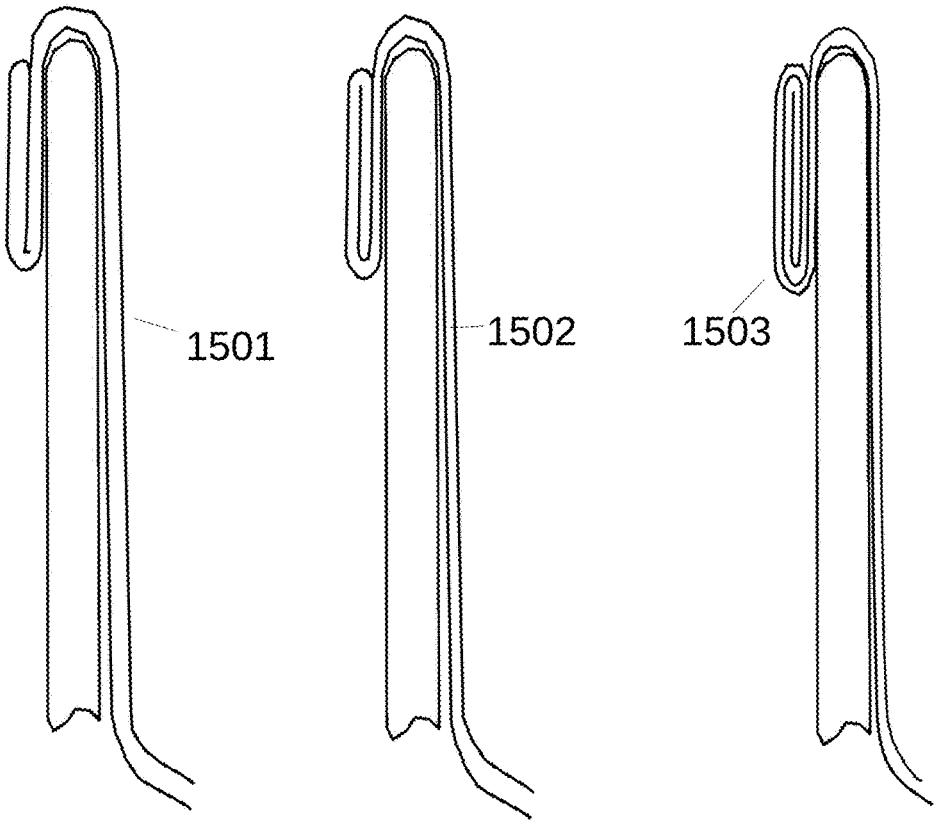
FIG. 15 exemplifies top portion designs of tarpaulins of three different thickness.

Please refer to FIG. 15. FIG. 15 exemplifies top portion designs of tarpaulins of three different thicknesses. In FIG. 15, the thickness of the tarpaulin 1501 in the left example is thickest, so that only two times folding are processed on the top portion. The tarpaulin 1502 in the middle example and the tarpaulin 1503 on the right example process three times folding and four times folding respectively according to the thicknesses. Although the thicknesses are different for these tarpaulins, however, by adjusting the number of folding of the top portions of the tarpaulins, the overall thicknesses of top portions of the tarpaulins can be kept in predetermined sizes after enclosing the surrounding side frame. In other words, even for tarpaulins of different thicknesses, the overall top portions can be maintained in substantially similar thicknesses by this design. That is to say, the clip strips with the same top portion frame can be used in tarpaulins with different widths. The design can provide very good cost effectiveness for mold costs and raw material stockings.

Figure 16A:
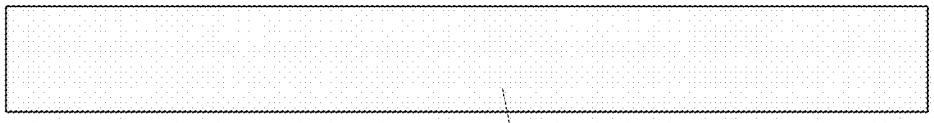
FIGS. 16A, 16B and 16C exemplify a top view, side view, and a stereogram of another design of a clip strip.
Figure 16B:
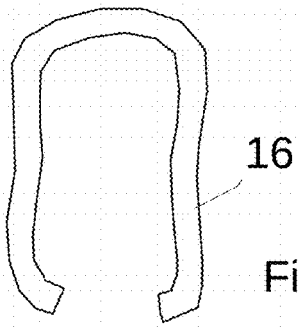
Figure 16C:
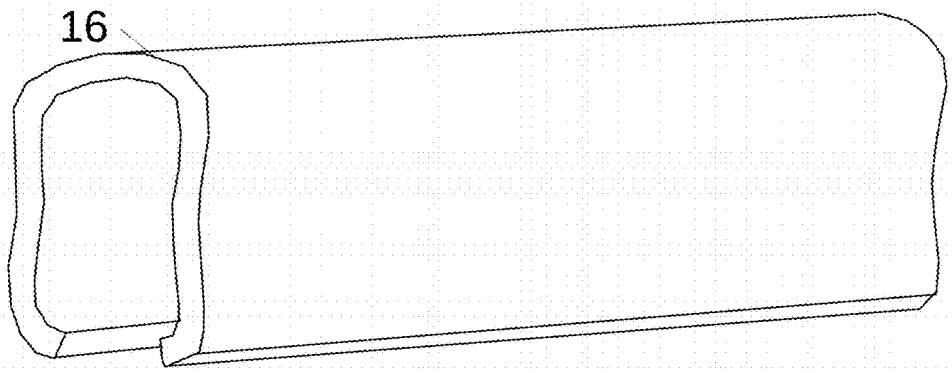

Please refer to FIGS. 16A, 16B, and 16C. FIGS. 16A, 16B and 16C exemplify a top view, side view, and a stereogram of another design of a clip strip. In FIGS. 16A, 16B, and 16C, the clip strip 16 reveals an substantially inverse U shape clip, defining an elastic trench configured to accommodate the top portion of the tarpaulin to process fixing.

Figure 17:
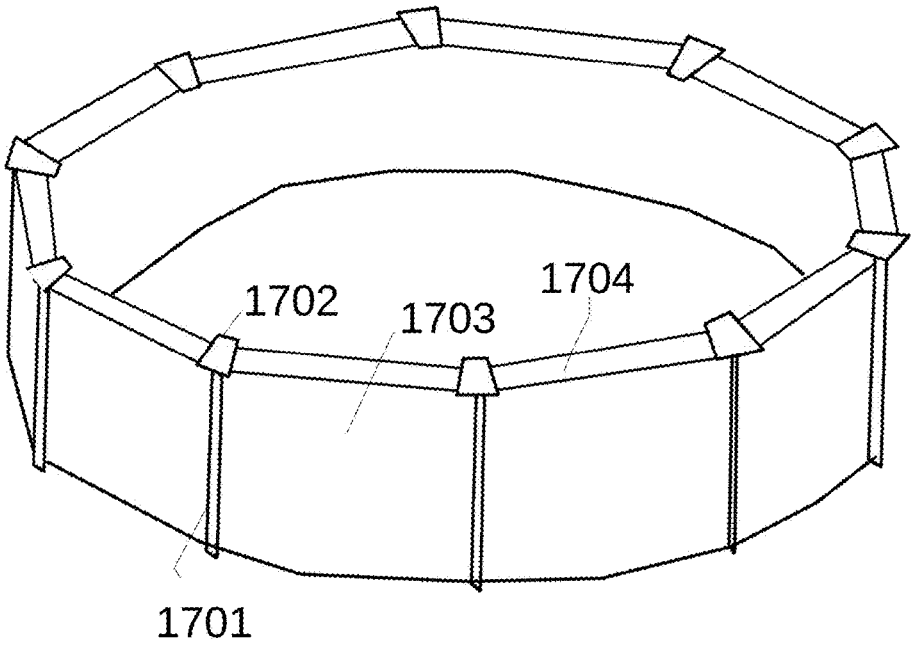
FIG. 17 exemplifies an embodiment of a pool apparatus.
Figure 18:
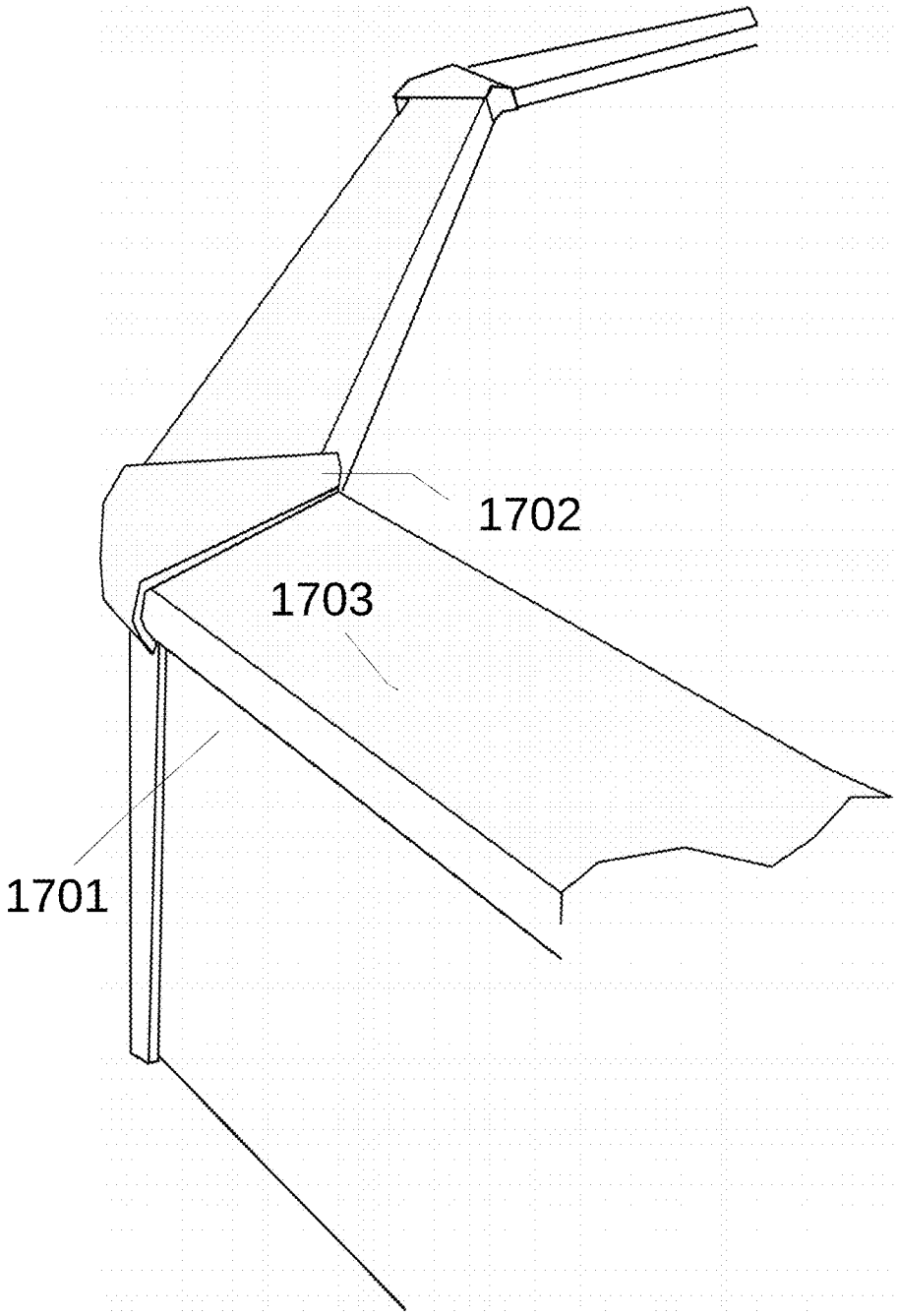
FIG. 18 exemplifies the local enlargement stereogram of FIG. 17.

Please refer to FIG. 17 and FIG. 18. FIG. 17 and FIG. 18 exemplify an embodiment of a pool apparatus. In the example, a surrounding side frame is constituted by including a plurality of side support frames 1701 and a frame structure 1703 supported by the side support frames 1701. In other words, the surrounding side frame of the whole pool apparatus is constituted by a plurality of rectangular frame structures 1703, the adjacent frame structures 1703 are connected and fixed via side support frames 1701, forming a needed geometrical shape. The connection between the side support frame 1701 and the frame structure 1703 can be processed by ways of various kinds of buckle structures. In addition, in the example, the top portion of the clip strips of the top portion frame have a flat surface 1704 with size over than three square centimeters, such as ten square centimeters or twenty square centimeters, configured to provide a place for putting on beverage cans or to enhance the comfort when users lying against the side of the pool. The clip strips constitute a polygon, and there is a corresponding corner buckle structure 1702 on the place of the connection between each pair of sides. The corner buckle structure 1702 fixes them in each side of the polygon together.

Certainly, in addition to the mentioned examples, the pool apparatus may also be designed to have other shapes, or the elements of the pool apparatus may make different combinations.

According to the same principles, more different deformable structures can be manufactured. Those who can achieve the effects in the invention should all be regarded as in the scope of the invention.

The above mentioned are only preferred specific embodiments of the invention, and are not thence restrictive to the scope of claims of the invention. Therefore, those who apply equivalent changes according to the contents from the invention should all belong to the scope of the invention.

What is claimed is:

1. A pool apparatus providing a place for people to do activities in the pool apparatus, the pool apparatus comprising:

a surrounding side frame for defining a closed geometrical shape above a ground after the surrounding side frame is surrounded with respect to the ground;

a tarpaulin having a bottom portion, a side portion, and a top portion, the shape of the bottom portion corresponding to the closed geometrical shape, the side portion connecting to the bottom portion and disposed about the surrounding side frame, the top portion connecting to the side portion, and the thickness of the top portion being thicker than the thickness of other portions of the tarpaulin; and a top portion frame configured to clip the top portion of the tarpaulin to the surrounding side frame to fix the tarpaulin;

wherein the surrounding side frame is constructed mainly by a rectangular thin sheet; and wherein the rectangular thin sheet has a plurality of folding lines in a direction substantially perpendicular to the ground.

2. The pool apparatus as claim 1, wherein the top portion of the tarpaulin has a folded portion, the folded portion being constructed by folding the tarpaulin with a predetermined folding number on the top portion region of the tarpaulin.

3. The pool apparatus as claim 1, wherein the thickness of the top portion of the tarpaulin is increased by adding to the top portion of the tarpaulin.

4. The pool apparatus as claim 1 wherein the rectangular thin sheet has metal material.

5. The pool apparatus as claim 1, wherein the surrounding side frame comprises a plurality of side support pillars and a plurality of frame surface structures, two sides of the frame surface structures being supported by corresponding two side support pillars of the plurality of side support pillars.

6. The pool apparatus as claim 1, wherein the top portion frame includes a plurality of clip strips, the clip strips having an elastic trench configured to clip the top portion of the tarpaulin to the surrounding side frame.

7. The pool apparatus as claim 6, wherein the clip strips include two long tubes and a long tube connection port, the long tube connection port connecting the two long tubes for providing a predetermined elastic force and forming the elastic trench between the two long tubes.

8. The pool apparatus as claim 7, wherein the clip strips further comprise a plurality of connection bolts for inserting the long tubes to connect different long tubes in series to constitute the top portion frame.

9. The pool apparatus as claim 8, wherein in the middle of the connection bolts has a blocking part configured to control the connection bolts and the relative positions between the two long tubes.

10. The pool apparatus as claim 8, further comprising an isolation bar being disposed inside the long tube to divide the interior of the long tube into two channels, wherein the connection bolts are inserted into one of the channels and a fixity between the connection bolts and the long tubes is strengthened with an elastic force generated by the deformation of the isolation bar caused by the insertion of the connection bolts into the long tubes.

11. The pool apparatus as claim 7, wherein the top portion frame comprises a corner buckle structure for connecting the plurality of clip strips to form the top surface frame, and the clip strips have a flat surface larger than three square centimeters on their top portion.

12. The pool apparatus as claim 6, wherein the clip strip has an inverse Ushape clip to constitute the elastic trench.

13. The pool apparatus as claim 6, wherein the top portion has a folded portion, the folded portion being constituted by folding the tarpaulin with a predetermined folding number on the top portion of the tarpaulin, the predetermined folding number being determined according to the thickness of the tarpaulin and the width of the entrance of the elastic trench.

14. The pool apparatus as claim 13, wherein for thinner tarpaulin, larger folding number on the top portion of the tarpaulin is provided to match the entrance width of the elastic trench.

15. The pool apparatus as claim 11, wherein after the folding of the top portion of the tarpaulin, the folded portions of the tarpaulin are fixed by heating welding.

16. The pool apparatus as claim 1, wherein a maximum width of the closed geometrical shape is larger than two meters, and a height of the surrounding side frame is larger than sixty centimeters.

17. The pool apparatus as claim 1, wherein the pool apparatus further comprises a bottom portion frame configured to carry the surrounding side frame above the bottom portion frame.

18. The pool apparatus as claim 1, wherein the side portion of the tarpaulin and the surrounding side frame have respectively two corresponding holes configured to form a water outlet and a water inlet to connect a filtering pump.

* * * * *